US006289993B1

(12) United States Patent
Dallas

(10) Patent No.: US 6,289,993 B1
(45) **Date of Patent: *Sep. 18, 2001**

(54) BLOWOUT PREVENTER PROTECTOR AND SETTING TOOL

(76) Inventor: L. Murray Dallas, 790 River Oaks Dr., Fairview, TX (US) 75069

( * ) Notice: Subject to any disclaimer, the term of this patent is extended or adjusted under 35 U.S.C. 154(b) by 0 days.

This patent is subject to a terminal disclaimer.

(21) Appl. No.: 09/338,752

(22) Filed: Jun. 23, 1999

(51) Int. Cl.[7] ..... E21B 33/068
(52) U.S. Cl. ..... 166/386; 166/77.51; 166/85.4
(58) Field of Search ..... 166/379, 380, 166/386, 382, 77.1, 88.1, 97.1, 77.4, 85.4, 77.51

(56) References Cited

U.S. PATENT DOCUMENTS

| | | | | |
|---|---|---|---|---|
| 4,241,786 | | 12/1980 | Bullen | 166/77 |
| 4,632,183 | | 12/1986 | McLeod | 166/77 |
| 4,867,243 | | 9/1989 | Garner et al. | 66/379 |
| 5,332,044 | * | 7/1994 | Dallas et al. | 166/386 |
| 5,372,202 | * | 12/1994 | Dallas | 166/386 |
| 5,785,121 | | 7/1998 | Dallas | 166/90.1 |
| 5,819,851 | | 10/1998 | Dallas | 166/308 |
| 5,927,403 | | 7/1999 | Dallas | 166/77.51 |
| 6,009,941 | | 1/2000 | Haynes | 166/72 |
| 6,019,175 | | 2/2000 | Haynes | 166/382 |
| 6,220,363 | * | 4/2001 | Dallas | 166/382 |

* cited by examiner

*Primary Examiner*—William Neuder
(74) *Attorney, Agent, or Firm*—Nelson Mullins Riley & Scarborough, LLP

(57) ABSTRACT

A blowout preventer (BOP) protector featuring a low profile and a mechanical lockdown mechanism is described. The BOP protector includes a mandrel having an annular sealing body bonded to its bottom end for sealing engagement with a bit guide which protects a top of a casing of a well to be stimulated with acidifying or fracturing fluids. The mandrel is locked down with a mechanical lockdown mechanism having a broad range of adjustment. The advantages include a low profile, the security of a mechanical lockdown mechanism, and full access to the casing with downhole tools.

32 Claims, 4 Drawing Sheets

BLOWOUT PREVENTER PROTECTOR AND SETTING TOOL

TECHNICAL FIELD

The present invention relates to equipment for servicing oil and gas wells and, in particular, to an apparatus and method for protecting blowout preventers from exposure to high pressures and abrasive or corrosive fluids during well fracturing and stimulation procedures.

BACKGROUND OF THE INVENTION

Most oil and gas wells eventually require some form of stimulation to enhance hydrocarbon flow and make or keep them economically viable. The servicing of oil and gas wells to stimulate production requires the pumping of fluids under high pressure. The fluids are generally corrosive and abrasive because they are frequently laden with corrosive acids and abrasive proppants such as sharp sand.

In some wells, stimulation to improve production can be accomplished at moderate pressure which may be safely contained by blowout preventers (BOPs) and, therefore, stimulation fluids may be pumped directly through a valve attached to the BOPs. This procedure is adopted to minimize expense and to permit full access to the well casing with downhole tools during the well servicing operation. It has been demonstrated that it is advantageous to have full access, or substantially full access, to a well casing during a well stimulation treatment. Full access to the casing permits use of downhole tools which are often required, or at least advantageously used during a stimulation treatment.

An apparatus for providing full access to the casing while permitting stimulation treatments at extreme pressures that approach a burst pressure rating of the casing is described in Applicant's U.S. Pat. No. 5,819,851 which issued on Oct. 13, 1998 and is entitled BLOWOUT PREVENTER PROTECTOR FOR USE DURING HIGH PRESSURE OIL/GAS WELL STIMULATION. The patent describes an apparatus for protecting BOPs during well treatments to stimulate production. The apparatus includes a hollow spool that has spaced apart inner and outer side walls that define an annular cavity. A mandrel is forcibly reciprocatable in the cavity. The mandrel includes an annular seal at the bottom end for sealingly engaging a bit guide attached to the top end of the casing. The apparatus is mounted above a BOP attached to a casing spool of the well before well stimulation procedures have begun. The mandrel is stroked down through the BOP to protect it from exposure to fluid pressure as well as to abrasive and corrosive well stimulation fluids, especially extreme pressure and abrasive proppants. The BOP protector provides a simple, easy to operate apparatus for protecting BOPs which provides full access to the well casing with well servicing tools to facilitate well stimulation at pressures approaching the burst pressure rating of the well casing.

The BOP protector has been readily accepted by the industry and has been proven to be an effective tool which reduces the cost of well stimulation treatments while enabling an ultimate choice of treatment options. However, further improvements are still desirable because the BOP protector described in U.S. Pat. No. 5,819,851 is a hydraulic unit which is mounted above the BOPs during an entire stimulation process. This raises the high pressure valve which controls the flow of stimulation fluids well above a top of the BOPs, which complicates access and reduces the run-in room for perforating gun strings, and other lengthy tools. Consequently, a low profile BOP protector would be advantageous to lower the position of the high pressure valve for easy access during stimulation processes. In addition, a mechanical lockdown mechanism for securing the BOP protector mandrel in an operative position is considered more reliable because a source of pressurized hydraulic fluid is not required.

An apparatus and method of isolating a well tree located on an oil or gas well from the effects of high pressure or corrosion caused by stimulation of a well is described in Applicant's U.S. Pat. No. 4,867,243 which issued on Sep. 19, 1989 and is entitled WELLHEAD ISOLATION TOOL AND SETTING TOOL AND METHOD OF USING SAME. The patent describes an apparatus to permit the injection of fluids, gases, solid particles or mixtures thereof through a well tree while protecting the well tree during well stimulation treatments. The apparatus includes a single hydraulic cylinder supported in an axial alignment over a well tree by at least two elongated support rods. The hydraulic cylinder support rods are connected between a base plate and a hydraulic cylinder support plate for supporting the hydraulic cylinder above the well tree at a distance approximately equal to the height of the production tree. The apparatus permits the insertion of a single length of high pressure tubing through any well tree regardless of its height. Once the high pressure tubing is seated in a well tubing or casing, the hydraulic cylinder, hydraulic cylinder plate and support rods are removed to provide 360° access to a high pressure valve attached to the top of the high pressure tubing. The bottom end of the high pressure tubing has a packoff nipple assembly which is inserted into the production tubing or casing and seals against the inner wall. The extent to which the high pressure tubing extends into the production tubing or casing is unimportant so long as the packoff nipple assembly is sealed against the inner wall. Consequently, variations in the length of the production tree are of no consequence and a lockdown mechanism with a short reach is adequate. Consequently, there exists a need for a mechanical lockdown mechanism that provides a broad range of adjustment to permit packoff with a fixed packoff surface in a wellhead.

SUMMARY OF THE INVENTION

It is a primary object of the invention to provide a BOP protector which isolates BOPs from well stimulation pressures and fluids while overcoming the shortcomings of the prior art.

It is another object of the invention to provide a BOP protector which has a low profile for easy access to a high pressure valve during a stimulation treatment.

It is a further object of the invention to provide a BOP protector which is locked down in its operative position by a mechanical lockdown mechanism.

It is yet a further object of the invention to provide a BOP protector which has a mandrel that can be separated from a tool used for setting the mandrel.

It is still a further object of the invention to provide a BOP protector which is economical to manufacture and maintain.

In accordance with one aspect of the invention there is provided an apparatus for protecting a blowout preventer from exposure to fluid pressures, abrasives and corrosive fluids used in a well treatment to stimulate production. The apparatus comprises a mandrel adapted to be inserted down through the blowout preventer to an operative position. The mandrel has a mandrel top end and a mandrel bottom end, the mandrel bottom end including an annular sealing body for sealing engagement with a top of a casing of the well when the mandrel is in the operate position. A mechanical lockdown mechanism detachably secures the mandrel to the blowout preventer, the lockdown mechanism being adapted to ensure that the annular sealing body is securely seated against the top of the casing when the mandrel is in the operative position.

The mechanical lockdown mechanism preferably includes a base member that is adapted to be mounted to a top of the blowout preventer, the base member having a central passage to permit the insertion and removal of the mandrel. The passage is surrounded by an integral sleeve having an elongated spiral thread for engaging a lockdown nut that is adapted to secure the mandrel in the operative position. The spiral thread on the integral sleeve and the lockdown nut have a length adequate to ensure safe operation at well stimulation fluid pressures (10,000–15,000 psi). At least one of the spiral thread on the integral sleeve and the lockdown nut has a length adequate to provide a significant range of adjustment, preferably at least about 5" (12.5 cm), to compensate for variations in a distance between a top of the BOP and a bit guide in the tubing hanger spool where the mandrel packs off. The mandrel may be inserted through the blowout preventer using any type of insertion tool used for the insertion of well tree savers or casing savers. Once inserted, the mandrel is securely locked in its operative position by the mechanical lockdown mechanism.

In more specific terms, the invention provides an apparatus for protecting a blowout preventer from exposure to fluid pressures, abrasive and corrosive fluids during a well treatment to stimulate production. The apparatus comprises a mandrel adapted to be inserted down through the blowout preventer, the mandrel having a mandrel top end adapted to protrude above the blowout preventer and a mandrel bottom end that includes an annular sealing body for sealing engagement with a bit guide at a top of a casing of the well when the mandrel is in an operative position. A hydraulic cylinder is conveniently used for inserting the mandrel into and removing the mandrel from the blowout preventer. The hydraulic cylinder is supported by at least two elongated hydraulic cylinder support rods fixed relative to the blowout preventer for supporting the hydraulic cylinder in vertical and axial alignment with the blowout preventer, the support rods and the cylinder being removable when the mandrel is operatively inserted through the blowout preventer and the annular sealing body of the mandrel bottom end is seated against the bit guide. A mechanical lockdown mechanism detachably secures the mandrel to the blowout preventer when the mandrel is in the operative position.

A primary advantage of the invention is the low profile which provides easy access to a high pressure valve mounted to the top end of the mandrel to control fluid flow during a well stimulation treatment. A further advantage is the security provided by a mechanical lockdown mechanism, which eliminates concern respecting hydraulic fluid pressure losses in the hydraulic system used to lock down Applicant's prior art BOP protector. Furthermore, the separable insertion tool reduces manufacturing and maintenance costs of the apparatus because a single setting tool can be used to set a plurality of mandrels and a damaged or washed-out mandrel is easily replaced without dismantling the tool.

DETAILED DESCRIPTION OF THE PREFERRED EMBODIMENT

Figure 1:
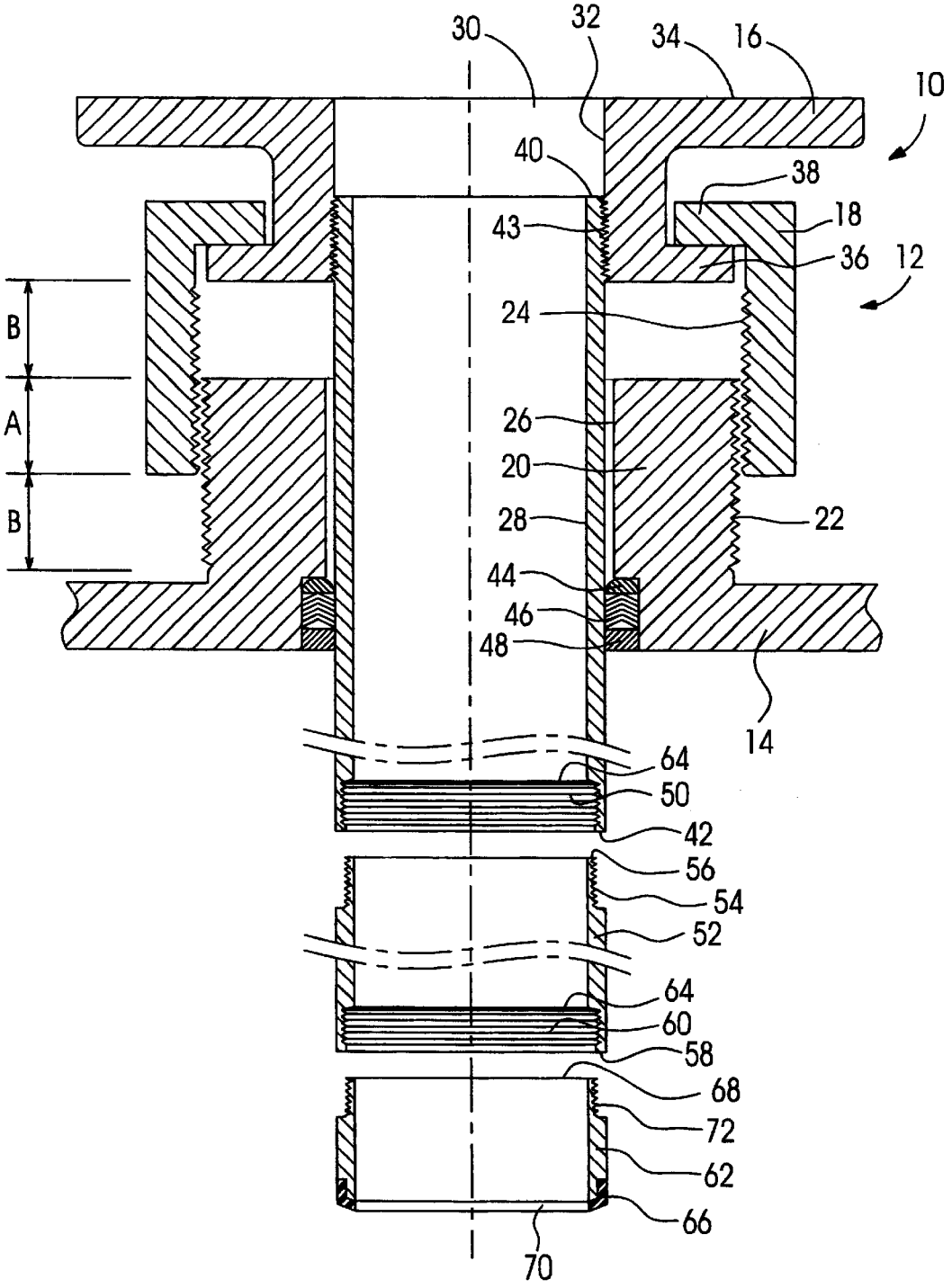
FIG. 1 is a longitudinal cross-sectional view of a blowout preventer (BOP) protector in accordance with the invention, showing the mandrel in an exploded view.

FIG. 1 shows a cross-sectional view of the apparatus for protecting the BOPs (hereinafter referred to as a BOP protector) in accordance with the invention, generally indicated by reference numeral 10. The apparatus includes a lockdown mechanism 12 which includes a base plate 14, a mandrel head 16 and a lockdown nut 18 which detachably interconnects the base plate 14 and the mandrel head 16. The base plate 14 is preferably a circular disc that includes an integral sleeve 20 which is perpendicular to the base plate 14. A spiral thread 22 is provided on an exterior of the integral sleeve 20. The spiral thread 22 is engageable with a complementary spiral thread 24 on an interior surface of the lockdown nut 18. The base plate 14 and the integral sleeve 20 provides a passage 26 to permit a mandrel 28 to pass therethrough. The mandrel head 16 is an annular flange, having a central passage 30 defined by an interior wall 32. A top flange 34 is adapted for connection of equipment, such as a high pressure valve, which will be described below in more detail. A lower flange 36 retains a top flange 38 of the lockdown nut 18. The lockdown nut 18 secures the mandrel head 16 from movement with respect to the base plate 14 when the lockdown nut 18 engages the spiral thread 22 of the integral sleeve 20. The mandrel head 16 with its upper and lower flanges 34, 36 and the lockdown nut 18 with its top flange 38 are illustrated in FIG. 1 as an integral unit assembled, for example, by welding or the like. However, persons skilled in the art will understand that either one of the mandrel head 16 and the lockdown nut 18 be constructed to permit disassembly to enable the mandrel head 16 or the lockdown nut 18 to be independently replaced.

The mandrel 28 has a mandrel top end 40 and a mandrel bottom end 42. Complementary spiral threads 43 are provided on the exterior of the mandrel top end 40 and on a lower end of the interior wall 32 of the mandrel head 16, so that the mandrel top end 40 may be securely attached to the mandrel head 16. One or more O-rings (not shown) provide a fluid tight seal between the mandrel head 34 and the mandrel 28. The passage 26 through the base plate 14 has a recessed region on the lower end for receiving a steel spacer 44 and packing rings 46 preferably constructed of brass, rubber and fabric. The steel spacer 44 and packing rings 46 define a passage of the same diameter as the periphery of the mandrel 28. The steel spacer 44 and packing rings 46 are removable and may be interchanged to accommodate different sizes of mandrel 28. The steel spacer 44 and packing rings 46 are retained in the passage 26 by a retainer nut 48.

The combination of the steel spacer 44, packing rings 46 and the retainer nut 48 provide a fluid seal to prevent passage to atmosphere of well fluids between the exterior of the mandrel 28 and the interior of the BOP when the mandrel 28 is inserted into the BOP, which will be described with reference to FIG. 3.

An internal threaded connector 50 on the mandrel bottom end 42 is adapted for the connection of mandrel extension sections of the same diameter. The extension sections permit the mandrel 28 to be lengthened as required by different wellhead configurations. An optional mandrel extension 52 has a threaded connector 54 at a top end 56 adapted to be threadedly connected to the mandrel bottom end 42. An extension bottom end 58 includes a threaded connector 60 that is used to connect a mandrel packoff assembly 62, which will be described below in more detail. High pressure O-ring seals 64, well known in the art, provide a high pressure fluid seal in the threaded connectors between the mandrel 28, the optional mandrel extension(s) 52 and the mandrel packoff assembly 62. The mandrel 28, the mandrel extension 52 and the mandrel packoff assembly 62 are preferably each made from 4140 steel, a high-strength steel which is commercially available. 4140 steel has a high tensile strength and a Burnell hardness of about 300. Consequently, the assembled mandrel 28 is adequately robust to contain extreme fluid pressures of up to 15,000 psi, which approaches the burst pressure of the well casing. In order to support a packoff gasket 66, however, the walls of the mandrel packoff assembly 62 are preferably about 1.75 inches (4.45 cm) thick. As will be explained with reference to FIG. 3, it is preferable that the wall thickness of the mandrel packoff assembly 62 be such that it fits closely within the tubing head spool of a well being treated.

The mandrel packoff assembly 62 includes a packoff upper end 68 and a packoff lower end 70. The packoff upper end 68 includes a threaded connector 72 which engages the threaded connector 50 on the lower end of the mandrel 28 or the threaded connector 60 on the extension bottom end 58 of the optional mandrel extension 52. The packoff lower end 70 includes the annular seal 66 which sealingly engages a top of the well casing as will be described below with reference to FIG. 3. The annular seal 66 is preferably a thermal plastic or a synthetic rubber seal that is bonded directly to the lower end 70 of the mandrel packoff assembly 62. The packoff lower end 70 is preferably machined to provide a bearing surface to which the annular seal 66 may be bonded. The annular seal 66 is preferably made from a polyurethane or a nitryl rubber. The annular seal 66 should have a hardness of about 80 to about 100 durometer. The internal diameter of the mandrel packoff assembly 62 is at least as large as the internal diameter of the casing, e.g., 5 inches (12.7 cm). The extension and the packoff assembly are more completely described in U.S. Pat. No. 5,819,851, which is incorporated herein by reference.

Figure 2:
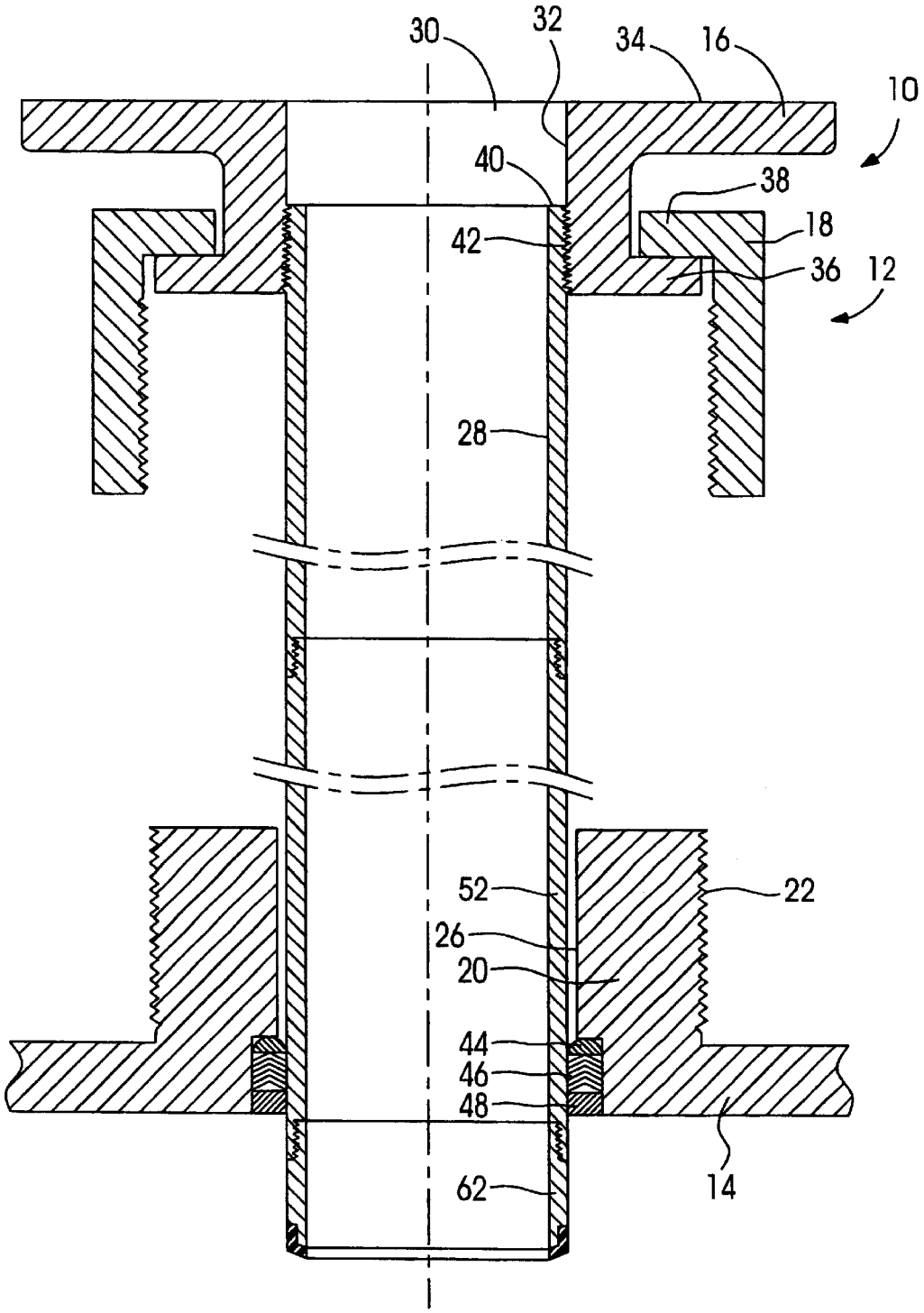
FIG. 2 is a longitudinal cross-sectional view of the BOP protector shown in FIG. 1, illustrating the lockdown nut disengaged from the base plate.

FIG. 2 illustrates the apparatus 10, shown in FIG. 1, prior to being mounted above a BOP for a well stimulation treatment. The lockdown nut 18 is disengaged from the integral sleeve 20 of the base plate 14 and the mandrel head 16 is connected to the top end 40 of the mandrel 28 which includes any required extension section(s) 52 and the packoff assembly 62 to provide a total length required for a particular wellhead. The base plate 14 is mounted on the top end of the BOP and the combination of the lockdown nut 18, the mandrel head 16 and the mandrel 28, inserted from the top into the BOP using any one of several insertion tools known in the industry.

Figure 3:
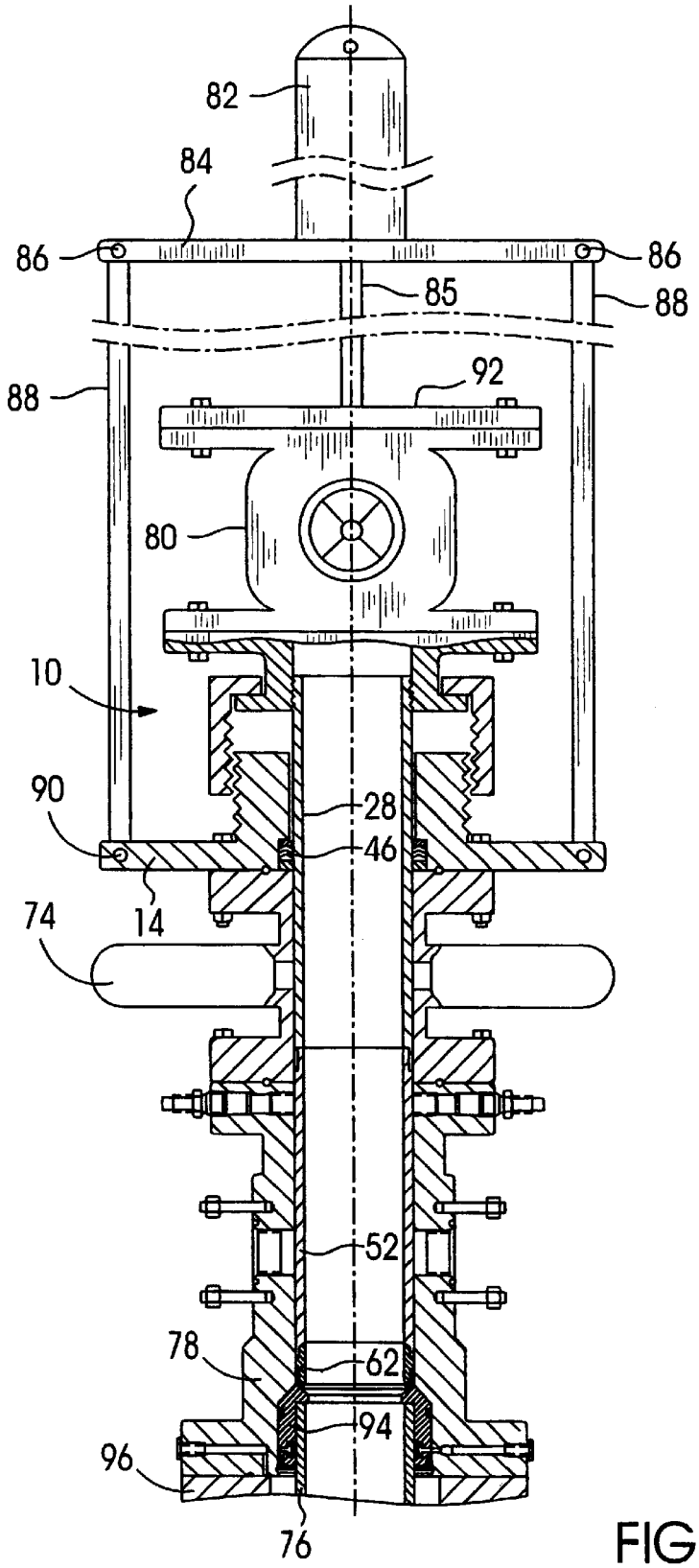
FIG. 3 is a front elevational view, partially in cross-section, of the BOP protector in accordance with the invention mounted to a wellhead with the mandrel inserted through the BOP and seated in its operative position.

FIG. 3 illustrates an example of the use of the BOP protector 10, shown in FIG. 1, using a hydraulic setting tool to insert the BOP protector 10 to an operative position for a well treatment to stimulate production. The hydraulic setting tool illustrated in FIG. 3 is described in U.S. Pat. No. 4,867,243, which is incorporated herein by reference. A BOP 74 is connected to a well casing 76 by various casing hangers, well known in the art such as a tubing head spool 78, for example. The BOP 74 is a piece of wellhead equipment that is also well known in the art and its construction and function do not form a part of this invention. The BOP 74 and the tubing head spool 78 are, therefore, not described. Mounted above the BOP protector 10, is a high pressure valve 80 which is used for fluid flow control during a well treatment to stimulate production and, also, used to prevent well fluids from escaping to atmosphere from the top of the mandrel 28 during the insertion and removal of the mandrel 28. The high pressure valve 80 is typically a hydraulic valve well known in the art. The hydraulic setting tool includes a hydraulic cylinder 82 which is mounted to support plate 84. The support plate 84 includes a passage (not shown) to permit a piston rod 85 of the hydraulic cylinder 82 to pass through the support plate 84. The support plate 84 also includes at least two attachment points 86 for attachment of respective hydraulic cylinder support rods 88. The spaced apart attachment points 86 are preferably equally spaced from the central bore to ensure that the hydraulic cylinder 82 and the piston rod 86 align with the BOP 74 to which the hydraulic cylinder 82 is mounted. The hydraulic cylinder support rods 88 are respectively attached on their lower ends to corresponding attachment points 90 on the base plate 14, which is mounted to the top of the BOP 74. As is apparent, the base plate 14 and the support plate 84 have a periphery that extends beyond the wellhead to provide enough radial offset of the cylinder support rods 88 to accommodate the high pressure valve 80. The cylinder support rods 88 are identical in length. The support rods 88 are attached to the respective spaced apart attachment points 86, 90 on the support plate 84 and the base plate 14 by means of threaded fasteners or pins (not illustrated). The piston rod 85 is attached to the top of the high pressure valve 80 by a connector 92 so that mechanical force can be applied to the BOP protector 10 and the attached high pressure valve 80 to stroke them in and out of the wellhead.

When the BOP protector 10 is in the operative position shown in FIG. 3, the bottom end of the packoff assembly 62 is in sealing contact with a bit guide 94 attached to a top of the casing 76. The bit guide 94 caps the casing 76 to protect the top end of the casing 76 and to provide a seal between the casing 76 and the tubing head spool 78 in a manner well known in the art. As noted above, the extension section(s) 52 is optional and of variable length so that the assembled mandrel 28, including the packoff assembly 62, has adequate length to ensure that the top end 40 of the mandrel 28 extends above the top of BOP 74 just enough to enable the mandrel to be secured by the lockdown assembly 12 described above when the packoff assembly 62 is seated against the bit guide 94. However, the distance from the top of the bit guide 94 to the top of the BOP 74 may vary to some extent in different wellheads. This variation cannot be accommodated by a conventional lockdown mechanism such as taught in Applicant's U.S. Pat. No. 4,867,243.

In accordance with the invention, the mechanical lockdown mechanism 12 is configured to provide a broad range of adjustment to compensate for variations in the distance from the top of the BOP 74 to the top end 40 of the mandrel 28. The complementary spiral threads 22, 24 (FIG. 1) on the respective integral sleeve 20 and lockdown nut 18 having a length adequate to provide the required compensation.

Preferably, the respective threads 22, 24 are at least about 9" (22.86 cm) in axial length. A minimum engagement for safely containing the elevated fluid pressures acting on the BOP protector 10 during a well treatment to stimulate production is represented by a section labelled "A" (FIG. 1). Sections "B" represent the adjustment available to compensate for variations in the distance from the top of the BOP 74 to the top end 40 of the mandrel 28. A spiral thread with about 9" of axial length provides about 5" of adjustment while ensuring that a minimum engagement of the lockdown nut 18 is maintained.

Figure 4:
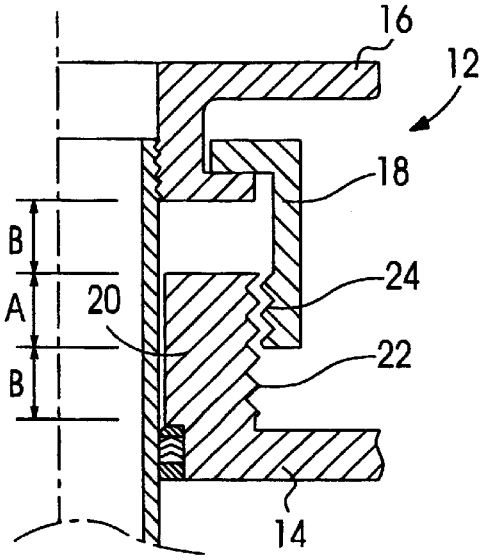
FIG. 4 is an alternate embodiment of the lockdown mechanism used in the BOP protector shown in FIG. 1.
Figure 5:
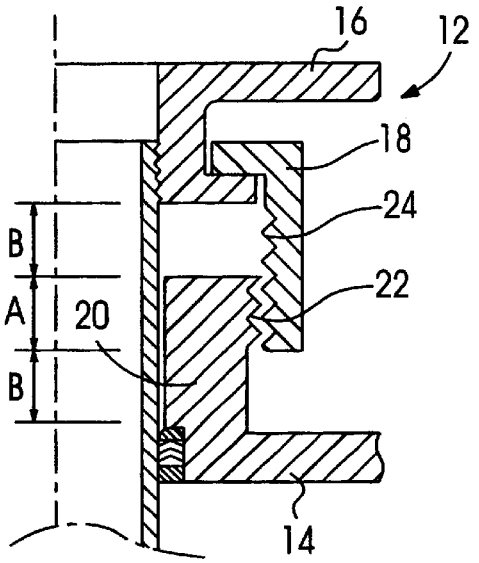
FIG. 5 is another alternate embodiment of the lockdown mechanism used in the BOP protector shown in FIG. 1.

FIGS. 4 and 5 illustrate two alternate embodiments of the mechanical lockdown mechanism 12 in accordance with the invention. In FIG. 4, the spiral thread 24 on the lockdown nut 18 has an axial extent "A" adequate to ensure the minimum engagement required for safety, and the thread 22 on the integral sleeve 20 of the base plate 14 has a full length spiral thread, which includes the "A" section for the minimum engagement and the "B" section for adjustment. The mechanical lockdown mechanism 12 illustrated in FIG. 5 provides a similar adjustable lockdown with length "A" for minimum safe threaded engagement on the integral sleeve 20 and length "B" for adjustment on the lockdown nut 18.

Figure 6:
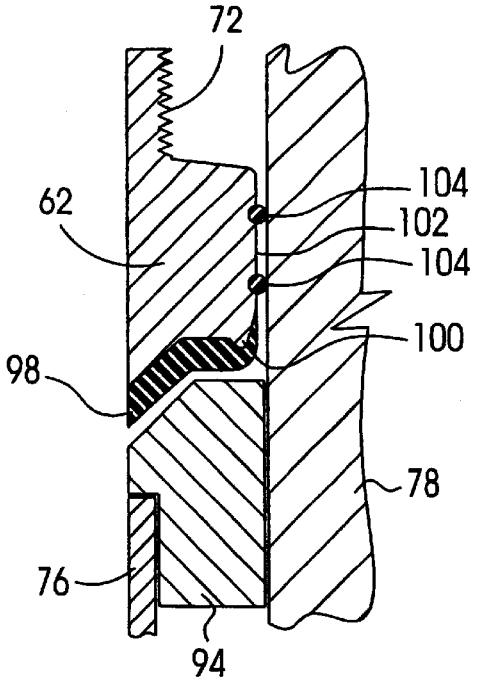
FIG. 6 is a partial cross-sectional view of a first embodiment of an annular sealing body for sealing against a bit guide mounted to a top of a casing of the well.
Figure 7:
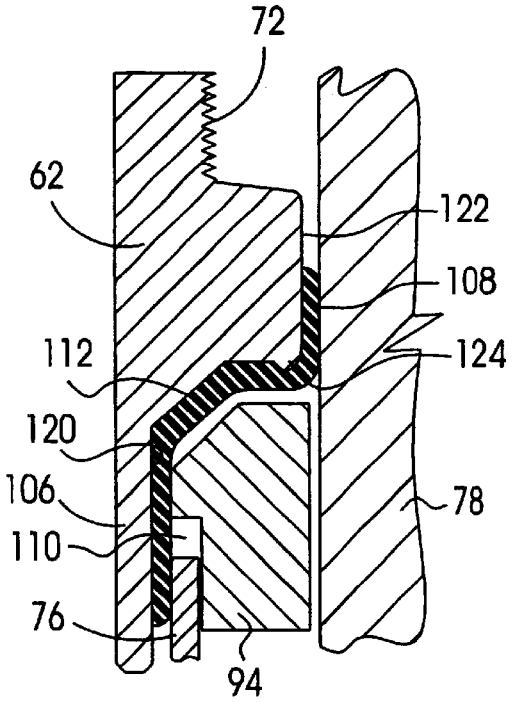
FIG. 7 is a partial cross-sectional view of an alternate preferred embodiment of an annular sealing body for sealing against a bit guide mounted to the top of a casing of the well.

FIGS. 6 and 7 illustrate the packoff assembly 62 in accordance with alternate embodiments of the invention. Field experience has shown that the bit guides of used wellheads tend to become deformed by small chips, dents, or scratches after a period of running in and out with production tubing and downhole tools. In such cases, the annualar seal used in the embodiment of FIG. 1 sometimes permits pressure leakage at high stimulation pressures and the packoff assembly 62 illustrated in FIGS. 6 and 7 may be used for the BOP protector 10 to improve performance, as described in Applicant's co-pending U.S. patent application Ser. No. 09/299,551, filed on Apr. 26, 1999 and entitled HIGH PRESSURE FLUID SEAL FOR SEALING AGAINST A BIT GUIDE IN A WELLHEAD AND METHOD OF USING, which is incorporated herein by reference. In FIG. 6, a high pressure fluid seal 98 is an elastomeric material preferably made from a plastic material such as polyethylene or a rubber compound such as nitryl rubber. The elastomeric material preferably has a hardness of about 80 to about 100 durometer. The high pressure fluid seal 10 is bonded directly to the bottom end of the packoff assembly 62. The bottom end of the packoff assembly 62 includes at least one downwardly protruding annular ridge 100 which provides an area of increased compression of the high pressure fluid seal 98 in an area preferably adjacent an outer wall 102 of the packoff assembly 62. The annular ridge 100 not only provides an area of increased compression, it also inhibits extrusion of the high pressure fluid seal 98 from a space between the packoff assembly 62 and the bit guide 94 when the mandrel 28 is exposed to extreme fluid pressures. The annular ridge 100 likewise helps ensure that the high pressure fluid seal 98 securely seats against the bit guide 94, even if the bit guide 94 is worn due to impact and abrasion resulting from the movement of the production tubing or well tools into or out of the casing 76. A pair of O-rings 104 are preferably provided as back-up seals to further ensure wellhead components are isolated from pressurized stimulation fluids.

The packoff assembly 62 illustrated in FIG. 7 has a thicker wall, and an inner wall 106 which extends downwardly past the bit guide 94 and a top edge of the casing 76 into an annulus of the casing 76. High pressure fluid seal 108 is particularly useful in wellheads where the bit guide 94 does not closely conform to the top edge of the casing 76, leaving a gap 110 in at least one area of circumference of a joint between the casing 76 and the bit guide 94. The gap makes the top edge of the casing 76 susceptible to erosion called "wash-out" if large volumes of abrasives are injected into the well during a well stimulation process. The packoff assembly 62 in accordance with this embodiment of the invention covers any gaps at the top end of the casing 76 to prevent wash-out. The length of the inner wall 106 is a matter of design choice. As noted above, the high pressure fluid seal 108 is bonded directly to the end 112 of the packoff assembly 62 using techniques well known in the art. The high pressure fluid seal 108 covers an outer wall portion 120 of the inner wall 106. It also covers a portion of an outer wall 122 located above the end 112. A bottom edge of the outer wall 122 of the packoff assembly 62 protrudes downwardly in an annular ridge 124 as described above to provide extra compression of the high pressure fluid seal 108 to ensure that the high pressure fluid seal 108 is not extruded from a space between the packoff assembly 62 and the bit guide 94 when the high pressure fluid seal 108 is securely seated against the top surface of the bit guide 94.

In use of the BOP protector 10, the base plate 14 is secured to the top of the BOP 74 with the lockdown nut 18 disengaged from the integral sleeve 20 of the base plate 14, as shown in FIG. 2. The combination of the mandrel 28, mandrel head 16 and the lockdown nut 18 may be supported by a rig or other insertion tool. The high pressure valve 80 is mounted to the upper flange 34 of the mandrel head before inserting the mandrel 28 into the BOP 74. The high pressure valve 80 is closed to prevent well fluids from escaping from the top end 40 of the mandrel head 28 when the mandrel 28 is inserted into the well. The BOP 74 is fully opened to permit the insertion of the mandrel 28. The mandrel 28 may be inserted through the BOP 74 using the hydraulic cylinder setting tool illustrated in FIG. 3. If so, the hydraulic cylinder 82, support plate 84 and the cylinder support rods 88 are mounted on the top of the wellhead in such a manner that the hydraulic cylinder 82 is supported in vertical and axial alignment with the BOP 74 with the piston rod 86 connected by the connector 92 to the top of the high pressure valve 80 and the cylinder support rods 88 attached at their lower ends to the respective attachment points 90 on the base plate 14. During insertion of the mandrel 28, well fluids are prevented from escaping to atmosphere by the packing rings 46 located between the mandrel top end 40 and the interior 32 of the mandrel head 16, which were described above with reference to FIG. 1. When the mandrel 28 is inserted to its operative position, the lockdown nut 18 is engaged with the threaded integral sleeve 26 of the base plate 14. The mandrel 28 is inserted into the BOP 74 until the annular seal 66 sealingly contacts the top of the bit guide 94 and the lockdown nut 18 is rotated down to its locking position so that the mandrel 28 is securely held in the operative position during the entire well treatment to stimulate production.

After the mandrel 28 is inserted into the operative position, the insertion tool is removed from the wellhead. The insertion tool is remounted to the wellhead after the well treatment to stimulate production is completed. The insertion tool is then operated to stroke the mandrel 28 upward out of the BOP 74. The BOP 74 is closed before the bottom end of the mandrel 28 is completely withdrawn from the base plate 14 to prevent well fluids from escaping to atmosphere. After the BOP 74 is closed, the entire assembly of the BOP protector 10 and the high pressure valve 80 as well as the hydraulic setting tool is removed from the top of the BOP 74. The sequence of the steps described above may be changed to adapt to specific circumstances, as will be apparent to persons skilled in the art.

Although a hydraulic setting tool as described above with reference to FIG. 3 has been used to illustrate the use of the preferred embodiment of the invention, other types of setting tool may be used for inserting the mandrel 28 through the BOP 74 to the operative position. For example, a setting tool described by McLeod in U.S. Pat. No. 4,632,183 entitled INSERTION DRIVE SYSTEM FOR TREE SAVERS which issued on Dec. 5, 1984, the entire specification of which is incorporated herein by reference, may be used. Another type of setting tool which may also be used to insert the mandrel 28 is described by Bullen in U.S. Pat. No. 4,241,786 entitled WELL TREE SAVER which issued on May 2, 1979 and is also incorporated herein by reference in its entirety. Each of these patents describe an insertion tool in which the force applied to the top of the mandrel is applied by a pair of horizontally oriented beams which are parallel and spaced apart. The lower beam is attached to the top of the BOP, while the upper beam is attached to the mandrel head. A pair of jacks are operatively coupled between the upper and lower beams at respective ends to lower or raise the upper beam with respect to the lower beam so that a force is applied on the mandrel to insert the mandrel into or withdraw the mandrel from the BOP. Other setting tools or rigs known in the art may also be used to insert or remove the BOP protector in accordance with the invention.

Modifications and improvements to the above described embodiments of the invention may become apparent to those skilled in the art. The foregoing description is intended to be exemplary rather than limiting. The scope of the invention is therefore intended to be limited solely by the scope of the appended claims.

I claim:

1. An apparatus for protecting a blowout preventer from exposure to fluid pressures, abrasives and corrosive fluids used in a well treatment to stimulate production, comprising:

a mandrel adapted to be inserted down through the blowout preventer to an operative position, the mandrel having a mandrel top end and a mandrel bottom end, the mandrel bottom end including an annular sealing body for sealing engagement with a top of a casing of the well when the mandrel is in the operative position; and a mechanical lockdown mechanism for detachably securing the mandrel to the blowout preventer, the lockdown mechanism being adapted to ensure that the annular sealing body is securely seated against the top of the casing when the mandrel is in the operative position.

2. An apparatus as claimed in claim 1 wherein the mechanical lockdown mechanism comprises a base member fixed relative to the blowout preventer, the base member having a central bore to permit the insertion of the mandrel down through the blowout preventer and an elongated spiral thread for adjustably engaging a complementary thread of a lockdown nut which is adapted to lock the mandrel in the operative position.

3. An apparatus as claimed in claim 2 wherein the elongated spiral thread and the complementary thread of the lockdown nut have respective axial lengths adequate to compensate for variations in a distance between a top of the blowout preventer and the top of the casing of different wellheads to permit the mandrel to be secured in the operative position even if a length of the mandrel is not precisely matched with a particular wellhead.

4. An apparatus as claimed in claim 3 wherein a mandrel head is mounted to the mandrel top end, the mandrel head having a mandrel head bottom end received by the lockdown nut for detachably securing the mandrel to the base member, a mandrel head top end being adapted to permit connection of equipment to the top end of the mandrel, and a passage from the mandrel head top end to the mandrel head bottom head for fluid communication with the mandrel.

5. An apparatus as claimed in claim 4 wherein the base member includes a sealing device to prevent a passage of well fluids to atmosphere from a space between an exterior of the mandrel and an interior of the blowout preventer when the mandrel is inserted into the blowout preventer.

6. An apparatus as claimed in claim 1 wherein the annular sealing body is bonded to the bottom of the mandrel.

7. An apparatus as claimed in claim 6 wherein the annular sealing body comprises a plastic material.

8. An apparatus as claimed in claim 7 wherein the plastic material is a polyurethane having a hardness of 80–100 durometer.

9. An apparatus as claimed in claim 6 wherein the annular sealing body comprises a rubber material.

10. An apparatus as claimed in claim 9 wherein the rubber material is a nitryl rubber having a durometer hardness of 80–100 durometer.

11. An apparatus as claimed in claim 1 wherein the mandrel bottom end includes mandrel extension sections to permit a length of the mandrel to be increased, and the annular sealing body is bonded to a last of the extension sections.

12. An apparatus as claimed in claim 4 wherein an internal diameter of the mandrel and an internal diameter of the passage through the mandrel head are respectively at least as large as an internal diameter of the casing.

13. An apparatus as claimed in claim 5 wherein the base member includes a base plate having an elongated sleeve perpendicular to the base plate, an interior of the sleeve forming the central bore and an exterior of the sleeve forming the elongated spiral thread, the base plate being adapted to be detachably mounted to the top of the blowout preventer.

14. An apparatus as claimed in claim 13 further comprising a hydraulic cylinder for inserting the mandrel into and removing the mandrel from the blowout preventer; and at least two elongated hydraulic cylinder support rods fixed relative to the base plate for supporting the hydraulic cylinder in vertical and axial alignment with the blowout preventer, the support rods and the hydraulic cylinder being removable when the mandrel is in the operative position, and the annular sealing body of the mandrel bottom end is securely seated against the top of the casing.

15. An apparatus as claimed in claim 14 wherein the hydraulic cylinder is mounted to a support plate having a central bore to permit the passage of a piston rod of the cylinder therethrough for the insertion and removal of the mandrel, the elongated cylinder support rods being attached at one end to spaced-apart points on the support plate and at the other end to respectively opposing points on the base plate, the support plate being removable with the hydraulic cylinder and the elongated cylinder support rods after insertion of the mandrel to the operative position.

16. An apparatus as claimed in claim 1 wherein the mandrel bottom end includes an annular ridge which protrudes into the annular sealing body to inhibit the annular sealing body from being extruded away from an inner wall of the mandrel when the annular sealing body is seated against a bit guide mounted on the top of the casing and the inner wall of the mandrel is subjected to elevated fluid pressure.

17. An apparatus as claimed in claim 16 wherein the mandrel bottom end has an outer wall including at least one radial groove for supporting at least one O-ring adapted to make sealing contact with an interior surface of a tubing head when the annular sealing body is seated against the bit guide.

18. An apparatus as claimed in claim 16 wherein the mandrel bottom end includes an annular extension of the inner wall that extends past the bit guide and into an annulus of the casing to protect a top edge of the casing from erosion caused by abrasives pumped into the casing during the stimulation treatment.

19. An apparatus as claimed in claim 18 wherein the extension of the inner wall has an outer wall portion that is also covered by the annular sealing body.

20. An apparatus for protecting a blowout preventer from exposure to fluid pressures, abrasive and corrosive fluids during a well treatment to stimulate production, comprising:

a mandrel adapted to be inserted down through the blowout preventer, the mandrel having a mandrel top end adapted to protrude above the blowout preventer and a mandrel bottom end that includes an annular sealing body for sealing engagement with a bit guide at a top of a casing of the well when the mandrel is in an operative position;

a hydraulic cylinder for inserting the mandrel into and removing the mandrel from the blowout preventer;

at least two elongated hydraulic cylinder support rods fixed relative to the blowout preventer for supporting the hydraulic cylinder in vertical and axial alignment with the blowout preventer, the support rods and the cylinder being removable when the mandrel is operatively inserted through the blowout preventer and the annular sealing body of the mandrel bottom end is seated against the bit guide; and a mechanical lockdown mechanism for detachably securing the mandrel to the blowout preventer when the mandrel is in the operative position.

21. An apparatus as claimed in claim 20 further comprising:

a base member adapted for attachment to a top of the blowout preventer, the base member including a passage to permit the insertion of the mandrel and at least two spaced-apart points of attachment for the elongated cylinder support rods, the points of attachment being equidistant from the passage; and the hydraulic cylinder being mounted to a support plate having a bore to permit the passage of a piton rod of the hydraulic cylinder therethrough, and at least two spaced-apart points of attachment for the elongated cylinder support rods, the points of attachment being complementary with the points of attachment on the base member, the support plate being removable with the hydraulic cylinder and the elongated cylinder support rods from the base member after insertion of the mandrel to the operative position.

22. An apparatus as claimed in claim 21 wherein the base member includes an elongated perpendicular sleeve that surrounds the passage through the base member, the elongated sleeve having an exterior wall with a spiral thread for engagement with a complementary spiral thread of a lockdown nut that is adapted to lock the mandrel in the operative position.

23. An apparatus as claimed in claim 22 wherein the spiral thread on the sleeve and the complementary spiral thread on the lockdown nut have respective axial lengths adequate to compensate for variations in length of a wellhead through which the mandrel is inserted.

24. An apparatus as claimed in claim 21 wherein the base member includes a seal adapted to prevent the passage to atmosphere of well fluids in a space between an exterior of the mandrel and an interior of the blowout preventer when the mandrel is inserted into the blowout preventer.

25. An apparatus as claimed in claim 24 wherein a mandrel head is mounted to the top end of the mandrel, the mandrel head having a mandrel head bottom end received by the lockdown nut for detachably securing the mandrel to the base member, a mandrel head top end adapted to be connected to the piston rod of the hydraulic cylinder, and a passage from the mandrel head top end to the mandrel head bottom head in fluid communication with the mandrel when the mandrel is connected to the mandrel head.

26. An apparatus as claimed in claim 20 wherein the mandrel bottom end includes a mandrel extension section to permit a length of the mandrel to be increased, and the annular sealing body is bonded to a last of the extension sections.

27. A method for protecting a blowout preventer from exposure to fluid pressure as well as to abrasive and corrosive fluids during a well treatment to stimulate production, comprising the steps of:

a) mounting above the blowout preventer an apparatus for protecting the blowout preventer from exposure to fluid pressures, abrasive and corrosive fluids during a well treatment to stimulate production, comprising a mandrel having a mandrel top end and a mandrel bottom end that includes an annular sealing body, and a mechanical lockdown mechanism for detachably securing the mandrel to the blowout preventer;

b) mounting at least one high pressure valve to the apparatus in operative fluid communication with the mandrel;

c) closing the at least one high pressure valve;

d) fully opening the blowout preventer;

e) applying a force on the mandrel top end to move the mandrel bottom end down through the blowout preventer until the mandrel is in an operative position in which the annular sealing body is in fluid sealing engagement with a top of a casing of the well while the mandrel top end extends above the blowout preventer;

f) engaging the mechanical lockdown mechanism to lock the mandrel in the operative position; and g) disengaging the mechanical lockdown mechanism, pulling up the mandrel, closing the blowout preventer, and removing the apparatus from the blowout preventer in a reverse sequence of steps a) to f) after the well treatment to stimulate production.

28. A method as claimed in claim 27 further comprising steps: before step e), mounting atop the blowout preventer a hydraulic cylinder that is supported in vertical and axial alignment with the blowout preventer by at least two elongated hydraulic cylinder support rods fixed relative to the blowout preventer to ensure a piston rod of the hydraulic cylinder is enabled to apply force to a top of the mandrel; and after step f), removing the hydraulic cylinder and the support rods from the blowout preventer.

29. A method as claimed in claim 28 further comprising in step g) remounting the support rods and the hydraulic cylinder to the top of the blowout preventer to remove the mandrel, and subsequently removing the hydraulic cylinder and the support rods from the blowout preventer after the mandrel is withdrawn from the blowout preventer.

30. A method as claimed in claim 27 wherein the annular sealing body seals against a bit guide which engages the top of the casing in the fluid tight seal.

31. A method as claimed in claim 27 wherein the mandrel includes mandrel extension sections threadedly attached to a main section of said mandrel and includes a mandrel packoff assembly, and wherein the annular sealing body is bonded to a bottom end of the mandrel packoff assembly.

32. A method as claimed in claim 27 wherein the force applied to the top end of the mandrel is applied by a pair of parallel, spaced beams, a lower one of which is attached to a top of the blowout preventer, the mandrel being attached to the upper beam and inserted into or withdrawn from the blowout preventer by jack assemblies which lower or raise the upper beam with respect to the lower beam.

* * * * *